United States Patent [19]

Cappel et al.

[11] 4,065,295

[45] Dec. 27, 1977

[54] SINTER MACHINE CONTROL AS A FUNCTION OF WASTE GAS TEMPERATURE

[75] Inventors: Fred Cappel, Sprendlingen; Walter Hastik, Frankfurt am Main, both of Germany; Georges Fleming; Pierre Hofmann, both of Esch Alzette, Luxembourg

[73] Assignee: Dravo Corporation, Pittsburgh, Pa.

[21] Appl. No.: 709,911

[22] Filed: July 29, 1976

[30] Foreign Application Priority Data

Sept. 24, 1975 Germany ..... 2542473

[51] Int. Cl.[2] ..... C22B 1/20

[52] U.S. Cl. ..... 75/5; 266/88

[58] Field of Search ..... 75/3, 4, 5; 266/87, 266/88

[56] References Cited

U.S. PATENT DOCUMENTS

| | | | |
|---|---|---|---|
| 3,211,441 | 10/1965 | Miyakawa et al. | 75/5 |
| 3,399,053 | 8/1968 | Shutz et al. | 75/5 |

*Primary Examiner*—L. Dewayne Rutledge
*Assistant Examiner*—Michael L. Lewis
*Attorney, Agent, or Firm*—Parmelee, Miller, Welsh & Kratz

[57] ABSTRACT

A process for controlling the speed of strand sintering machines through utilization of the temperature of collected waste gas as measured in the collector pipe as the controlled variable provides improved response by utilizing as an additional controlled variable the temperature of the waste gases at the windboxes. Either the average temperature of those waste gases that leave the windboxes at a temperature above approximately 100° C. or the location of the burn-through point as determined from the temperature of the waste gases at the windboxes can be used as the additional variable. In the latter case, the temperature of the collected waste gases can be used to automatically control the desired variable in a secondary cascade-type control loop in which the location of the burn-through point is the actual value and the travel speed is the regulated quantity.

3 Claims, 2 Drawing Figures

SINTER MACHINE CONTROL AS A FUNCTION OF WASTE GAS TEMPERATURE

BACKGROUND OF THE INVENTION

1. Field Of The Invention

This invention relates to a process for automatically controlling the velocity of strand sintering machines used in the sintering of iron-oxide bearing materials of fine particle size to maintain the burn-through point of the sintering mixture ahead of the discharge end of the machine and more particularly to such a process wherein the controlled variable used for this purpose is the temperature of the waste gases of the sintering operation taken at a point in the collecting pipe.

2. Prior Art

In the sintering operation of iron ores on strand sintering machines, the mixture to be sintered contains a fuel and the upper layer of the bed is ignited; a gas containing oxygen, air usually, is pulled through the mixture. The combustion zone then travels down vertically within the sintering mixture. The point where the combustion zone reaches either the fire bars or the grizzly layer is called the burn-through point. In processes where the sintered product is not cooled on the sintering strand, the burn-through point must lie close to the discharge end so as to utilize as fully as possible the sintering capacity of the machines and so as to avoid damage to the aggregates stemming from an early discharge and the discharge of unsintered material. In processes using partial cooling of the sinter on the sintering strand, the burn-through point must lie at a predetermined location which is held as constant as possible so as to realize constancy of operating conditions. To this end, it is necessary to adapt the travel speed of the strand sintering machines to the sintering velocity within the bed.

The ratio of the strand length L to the bed depth h is equal to the ratio of the appropriate strand travel speed $V_M$ to the vertical sintering velocity $V_S$. Thus: $L = \text{const} = V_M \times 1/V_S \times h$. One can achieve automatic control by acting on the vertical sintering velocity, for example, by adjusting correspondingly the controls of the waste gas blower. But this would mean that the blower cannot always be used to its full capacity. For the same reason, the automatic control of the sintering velocity through choking of the waste gas flow is not taken into consideration. To achieve automatic control, one cannot resort to the bed depth since adjustments of the latter will result in variations of sinter properties, fuel requirements and sintering machine capacity. The only possibility left is thus to automatically control the velocity of the sintering machine. $V_S$ cannot be measured directly and one must rely upon a different criterion to follow the progress of the sintering operation.

Various processes are known for automatically controlling the travel speed (Cappel, Wendeborn "Sintering of Iron-Ores," Verlag Stahleisen m.b.H., Dusseldorf, 1973, pp. 251–253). When the automatic control is based upon the temperature distribution in the waste gases near the end of the strand, the tightness of the end face has an effect. When the last windbox or partial windbox is very short, a large air leakage at that spot can produce a shift in the peak value of the waste gas temperature; the temperature is then actually determined by the magnitude of the leakage at the end face. On the other hand, if the maximum temperature is not very pronounced, it is difficult to determine.

Furthermore, in this method of automatic control, the desired value of the location of the maximum temperature can be adjusted only within narrow limits; for larger limits, one must change the location of the temperature sensors; this is because the behavior of the waste gas temperature is assumed to be parabolic, but this is only valid in the vicinity of the maximum. For various ores, the temperature profile is flat anyway because the permeability of the bottom layers is very dependent on localized heat effects. In these cases, the maximum temperature of the waste gases is not a reliable criterion for the completion of sintering.

So as to avoid these difficulties, one has resorted also to another controlled variable: the temperature of the waste gases in the collector pipe at a point located before the inlet to the electric filter. The earlier the completion of the sintering process, the longer the sinter cools on the machine and the more heat is transferred from the sinter to the waste gas. A steady waste gas temperature corresponds to a steady travel of the ignited zone in the bed. The waste gas temperature is thus an appropriate measure of the progress of the process. This method of automatic control has, however, a large time constant.

SUMMARY OF THE INVENTION

This invention seeks to avoid the difficulties encountered in the known processes and to achieve a low time constant automatic control using the temperature of the waste gases in the gas collector.

In this invention, the solution to this problem is to use as an additional controlled variable to regulate machine travel speed: the temperature of the waste gases at the windboxes. An empirical determination gives the waste gas temperature in the gas collector corresponding to the desired location of the burn-through point. In general, this temperature measurement is performed ahead of the blower and this temperature should thus stay above the dew-point of sulfuric acid. When the desired value of this controlled temperature is exceeded, the travel speed is raised, while when the actual temperature falls short of its desired value, the travel speed is decreased.

In one case, this invention uses as secondary controlled variable to the temperature in the gas collector the variation in average temperature of those gases that leave the windboxes with a temperature above about 100° C. A rise in this average temperature causes an increase in travel speed, while a drop causes a decrease in speed. The additional controlled variable can be connected in parallel or in cascade. The behavior of the automatic control achieved is excellent, since the average temperature precedes the waste gas temperature in the gas collector by several minutes. This method of automatic control is applicable as well in installations where there is no temperature maximum in the last windboxes or where this temperature maximum is unreliable.

In another case, this invention uses the temperature of the collected waste gases to automatically control the desired value of the control variable in a secondary control loop connected in cascade; in this secondary loop, the regulated quantity is the sintering machine velocity while the controlling variable is the actual location of the burn-through point. Thus the secondary control loop acts on the travel speed and is controlled by the location of the waste gas temperature maximum, while in the primary control loop, the waste gas temperature in the collector controls the desired value of the variable controlled in the secondary loop, i.e., the desired location of the maximum temperature. A very good automatic control behavior results; it allows an automatic control of the waste gas temperature with a spread of only about 50° C. This method of automatic control is applicable in installations exhibiting a well-marked temperature peak in the last windboxes of the sintering region.

BRIEF DESCRIPTION OF THE DRAWINGS

The figures illustrate how the invention is incorporated in the process.

DESCRIPTION OF THE PREFERRED EMBODIMENT

Figure 1:
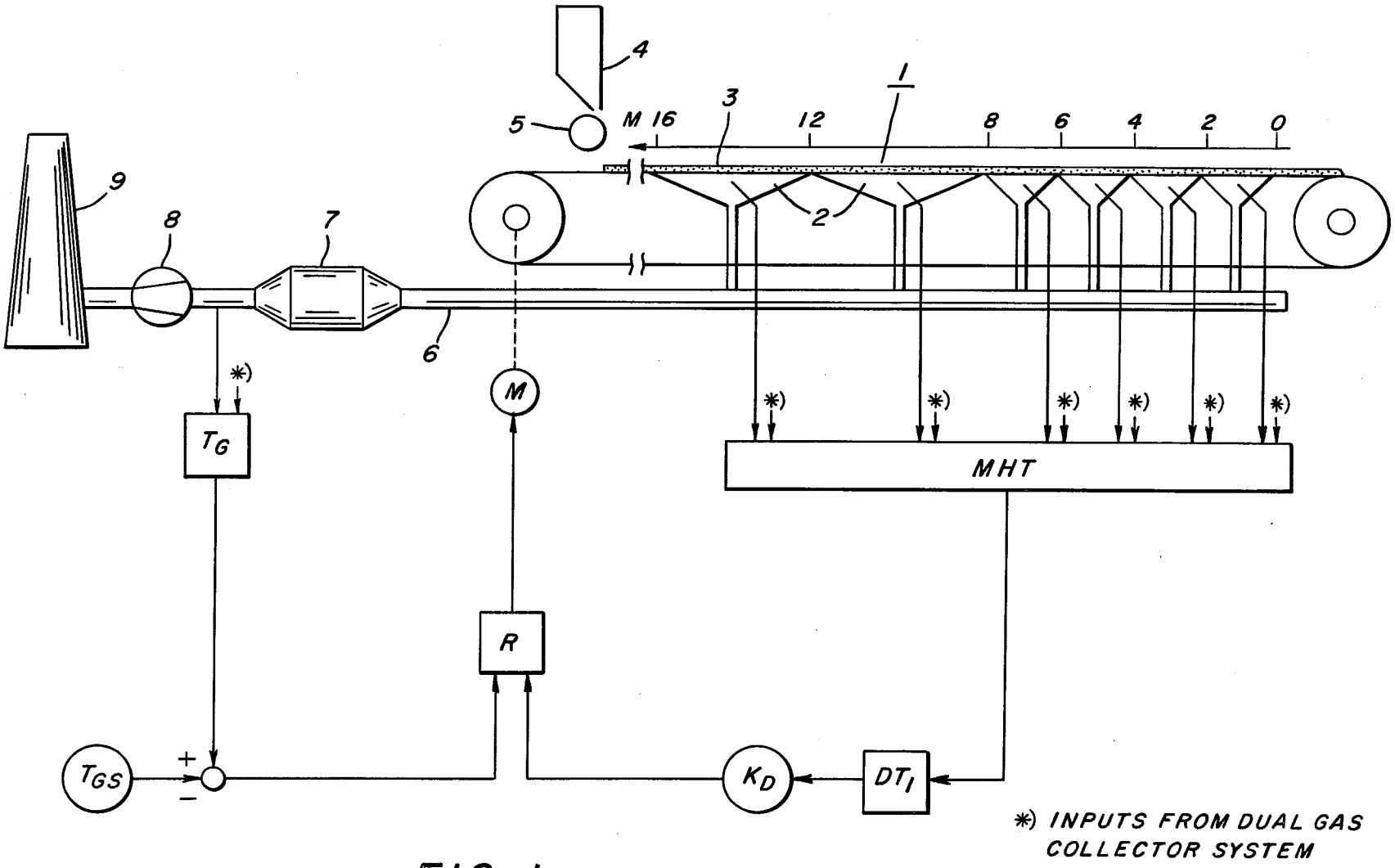
FIG. 1 is a schematic diagram of a sintering machine control system incorporating the process of this invention wherein the additional controlled variable is the average temperature of those waste gases that leave the windboxes at a temperature above about 100° C.

In the drawings, the strand sintering machine 1 is provided with windboxes 2 which draw hot gases through the layer of sinter mixture 3. The sinter mixture supplied by bin 4 is evenly applied to the working surface of the machine by roller 5. The hot gases from the windboxes are collected in pipe 6 and drawn through an electric filter 7 by a blower 8 before being discharged by stack 9. The length of the machine equipped with windboxes can by in the neighborhood of eighty meters. In the drawings the machine is not shown in full length as indicated by the broken lines.

In FIG. 1, the average value of the temperature of the waste gases (actual value) is calculated in block MHT and is fed to the controller R via a difference element $DT_1$ and a selectable influence factor $K_d$. The difference element can be performed as a numerical algorithm in the computer; special segments of the program insure good operation in start-up and break-down situations. $T_G$ is the temperature of the collected waste gases as measured in the collecting pipe 6 past the electric filter 7 and ahead of the blower 8; $T_{GS}$ is the desired value of this temperature. M is a servomotor acting on the driving motor.

Figure 2:
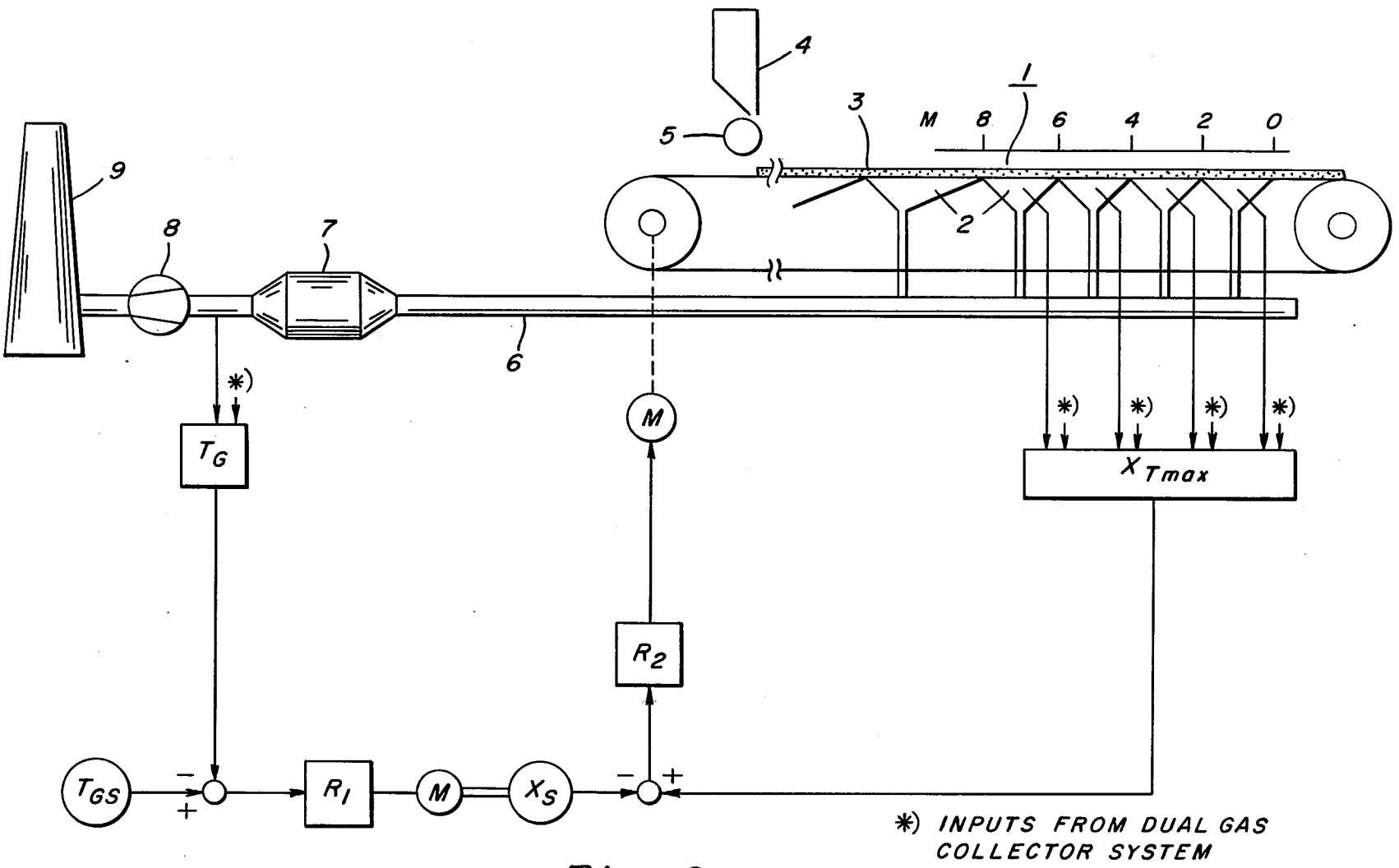
FIG. 2 is a schematic diagram of a sintering machine control system incorporating the process of this invention wherein the additional control variable is the location of the burn-through point.

In FIG. 2, the location of the temperature maximum and thus that of the burn-through point are determined in block $T_{max}$. The control system is of the cascade type; the waste gas temperature controller $R_1$ adjusts the desired value $X_S$ for the burn-through point controller $R_2$.

The strand sintering machine is equipped with windboxes on two sides. The inputs from the second waste gas system are indicated schematically by the asterisks in the drawings.

We claim:

1. A process for the automatic control of the travel speed of strand sintering machines used in the sintering of iron-oxide bearing materials of fine particle size in which gas is drawn through the iron-oxide bearing materials into windboxes and is collected in a collecting pipe and in which the speed of the sintering machine is controlled to keep the burn-through point ahead of the discharge end of the machine by measuring the temperature of the collected waste gases in the collecting pipe, generating a first signal as a function thereof, applying said first signal to a regulator to generate a motor speed control signal and applying said speed control signal to a sinter machine drive motor control to control the speed of the machine as a function of the collected waste gas temperature and generating a second signal as a function of the temperature of the waste gases at the windboxes and applying said second signal to said regulator to modify the speed control signal whereby the speed of the sinter machine is controlled as a function of the collected waste gas temperature as modified by the temperature of the waste gases at the windboxes.

2. The process according to claim 1, wherein said second signal is generated as a function of the change in the average value of the temperature of those gases that leave the windboxes above approximately 100° C and is applied to said regulator in parallel with said first signal.

3. The process according to claim 1, wherein said second signal is generated as a function of the location of the maximum windbox temperature and therefore of the burn-through point, first signal is generated as a function of the waste gas temperature in the collecting pipe as a set point for the second signal, third signal is generated as the difference between said first and second signals, and said third signal is applied to said regulator to generate said speed control signal.

* * * * *